US006293132B1

(12) United States Patent
Drigani et al.

(10) Patent No.: US 6,293,132 B1
(45) Date of Patent: Sep. 25, 2001

(54) CAROUSEL WINDING REEL

(75) Inventors: Fausto Drigani, Pozzuolo del Friuli; Cesare Galletti, Segrate S. Felice, both of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/554,007

(22) PCT Filed: Nov. 3, 1997

(86) PCT No.: PCT/IB98/01758

§ 371 Date: Jun. 26, 2000

§ 102(e) Date: Jun. 26, 2000

(87) PCT Pub. No.: WO99/24188

PCT Pub. Date: May 20, 1999

(30) Foreign Application Priority Data

Nov. 10, 1997 (IT) ..... UD97A0209
Sep. 29, 1998 (IT) ..... UD98A0162

(51) Int. Cl.[7] ..... B21C 47/00

(52) U.S. Cl. ..... 72/148; 72/202; 242/533.6; 242/530

(58) Field of Search ..... 72/146, 148, 200, 72/201, 202; 242/533.4, 533.5, 533.6, 539

(56) References Cited

U.S. PATENT DOCUMENTS 4,761,983 * 8/1988 Ginzburg et al. ..... 72/148
5,904,313 * 5/1999 Perret et al. ..... 242/533.6
6,089,067 * 7/2000 Yoshioka et al. ..... 72/148

FOREIGN PATENT DOCUMENTS 773278 5/1997 (EP) .
812634 12/1997 (EP) .

OTHER PUBLICATIONS

Patent Abstracts of Japan vol. 010 No. 315 (M–529) Oct. 25, 1986 & JP 61 124478 A Jun. 12, 1986.

* cited by examiner

*Primary Examiner*—Ed Tolan
(74) *Attorney, Agent, or Firm*—Antonelli, Terry, Stout & Kraus, LLP

(57) ABSTRACT

Carousel winding reel (10) for thin or very thin strip/sheet, up to 0.5 mm, hot rolled and leaving in a continuous strip from a rolling train at speeds of 20 meters per second and more, the reel (10) comprising a pair of mandrels (11*a*, 11*b*) arranged with their respective axes parallel to each other (12*a*, 12*b*) and associated with a structure (13) able to rotate around a longitudinal axis (14) substantially between the axes (12*a*, 12*b*), the rotatable structure (13) including a front body side (28*a*) and a rear body side (28*b*), the mandrels (11*a*, 11*b*) including alternatively a position of winding and a stand by position, the drive means of the mandrels are motors (15*a*, 15*b*), the motors including a rotor (115) and stator (215), the body sides (28*a*, 28*b*) including the seatings (29) of the main bearings (18) of the rotor (115), the stator (215) being connected to at least one body side by anti-torsion means (27).

13 Claims, 2 Drawing Sheets

CAROUSEL WINDING REEL

FIELD OF THE INVENTION

This invention concerns a carousel winding reel for hot-rolled strip/sheet as set forth in the main claim.

The winding reel according to the invention is applied at the outlet of a finishing train in a continuous hot rolling line for thin or very thin strip/sheet, up to 0.5 mm, with speeds at outlet which may reach 20 metres per second and more.

BACKGROUND OF THE INVENTION

In the field of rolling flat products there is an increasingly marked tendency on the part of constructors to seek solutions for the high efficiency production of thin and ultra-thin rolled stock leaving the finishing train at ever greater speeds.

The thinner the strip is, the greater must be the speed at which it leaves the finishing train; this is because it is necessary to maintain the rolling temperature and the winding temperature within well-defined fields, for both technological and metallurgical reasons.

It is well-known that there is an increasing demand on the part of users for finished strip and sheet with a thickness of less than 1 mm, to as little as 0.5÷0.6 mm, since these values offer two possibilities:

- cold rolling can be eliminated and the hot rolled product may be used directly, or after pickling. This solution uses thicknesses of more than 0.6 mm.
- the rolling passes in cold rolling mills and also any intermediate heat treatments may be reduced. In this case thicknesses of less than 0.6 and as little as 0.1 mm are used.

Competition between the producing companies is linked, not only to the quality of the final product, but also to the speed with which the strip/sheet can be extracted from the finishing train and wound onto the respective collection means. The greater the speed, the higher the production.

In the light of the fact that there are more and more endless rolling systems, even in hot rolling mills, it has become evident that one of the main obstacles against obtaining, in a highly efficient and continuous manner, speeds of above 10 metres per second to as much as 20 metres per second and more, is that of coiling the strip/sheet as it leaves the finishing train.

For this purpose, the state of the art has developed a winding reel of the rotary type, which is placed at the outlet of the finishing train, and is called a carousel reel.

The winding reel includes at least two mandrels which exchange their working position alternately and continuously, that is to say the position in which they wind the strip as it leaves the finishing train and the position in which they wait for the subsequent strip.

With this solution the winding conditions are always the same, regardless of which mandrel the strip is wound onto.

This does not happen in conventional downcoilers where slight differences in functioning (which are difficult to compensate, because they have origins which cannot be controlled), as well as differences in the path followed by the strip, can cause different winding conditions which have an effect on the geometric quality of the coil and on the metallurgical quality of the strip.

In the winding cycle of the carousel winding reel, after the strip has started winding onto the first mandrel in the working position and a desired number of spirals have been wound, the reel rotates and, while the first mandrel continues and concludes the winding, the second mandrel places itself in the working position while it waits for the next strip.

At this point a shears element intervenes; it is placed between the finishing train and the entrance to the winding reel, and shears to size the strip with respect to the continuous rolled stock and thus obtains coils of finished weight.

Carousel winding reel such as are known to the state of the art therefore include at least a pair of winding mandrels associated with a supporting structure which is governed by a drive mechanism suitable to make it rotate through an arc of at least 180°, in order to perform the variations in the position of the said mandrels according to the step of the winding cycle.

In the state of the art the drive mechanisms for the mandrels include complex kinematisms with off-axis motors fixed to the floor which supply motion by means of kinematic chains including respective transmission gears, or which use transmission systems with a universal joint or similar.

Although these proposals of the state of the art are satisfactory for particular and limited applications, they have not shown themselves to be efficient enough in hot rolling mills where the radiance of the strip can cause thermal deformations of the structure and where it is necessary to begin winding at the same operating speed, something which never happens in cold rolling mills.

Moreover, these solutions do not obtain high productivity winding cycles with the extremely high outlet speeds of the strip/sheet from the finishing train, speeds of up to 20 metres per second and more, which present-day technology can achieve and with the ever more reduced thickness of the strip, as required by the market.

The limitations of the proposals known to the state of the art concern the resistance to stresses of a mechanical, heat and electric nature, given the violent slopes of acceleration/deceleration to which the mandrels are subjected during the steps preparatory to winding and at the end of winding.

To be more exact, the mandrel is subject to high torsional stress because of the axial distance with respect to the motor.

Other disadvantages concern the complexity of assemblydisassembly, the difficulty of maintenance operations, premature wear of the more delicate components of the kinematic chain and other problems.

JP-A-61.124478 teaches that every shaft of each mandrel is associated with an electric motor, the stator being made solid with the rotatable structure.

By extracting the mandrel shaft, which operates on bearings on the rotatable structure, it is possible to remove the electric motor once the stator has been disconnected from the rotatable structure.

This teaching is interesting, but there are considerable problems connected with the day-to-day maintenance of the mandrel, which is the object of frequent maintenance work, and with the non-routine maintenance of the motor.

Moreover, there are problems to arrange the rotor and the stator coaxial, and to arrange the mandrel shaft and the rotor coaxial.

EP-A-0.812.634, precisely to reduce the problems typical of JP-A-61.124478, teaches that the rotatable structure should have seatings onto which electric motors complete with casings are applied.

The casing bears the main bearings of the rotor and the assembly structure allows to extract the mandrel, extract the rotor alone and also with the mandrel and to disassemble the casing to remove the stator too.

This solution is also interesting, but has disadvantages such as the increased weight caused by the casings of the motor, the alignment of the main bearings of the rotor, the reduced rigidity of the structure, since the drawing force of the sheet or strip is supported by the individual casing, the connection between the casing and the rotatable structure when there are continuous vibrations and stresses, the centrifugal force which is discharged on the casing and on the clamping means.

The present applicants have designed, tested and embodied this invention to overcome the shortcomings of the state of the art and to achieve other advantages as will be shown hereinafter.

SUMMARY OF THE INVENTION

The invention is set forth and characterised in the main claim, while the dependent claims describe other characteristics of the invention.

The purpose of the invention is to provide a winding reel, specifically designed for the hot coiling of thin strip/sheet at high speed, that is to say at speeds higher than 10 metres per second to more than 20 metres per second, suitable to ensure high performance, greater torque transmitted, reliability, high productivity, efficiency, little maintenance, and high resistance to mechanical and heat stresses.

The winding reel according to the invention has a pair of mandrels rotating on their own longitudinal axis and associated with a structure able to rotate around an axis substantially between the axes of the mandrels.

The rotation of the structure during the winding cycle, as in a conventional system, serves to take the two mandrels alternately from the working position to the stand-by position and vice versa, so as to obtain coils of finished weight from strip leaving the finishing train continuously and at high speed.

The mandrels have respective motors mounted on the axis of the longitudinal axis of the mandrel.

The motors are the type with an axial cavity into which the shaft of the relative mandrel is inserted, torsionally connected; they are arranged immediately next to the rotatable structure which supports the mandrels and positions them circumferentially.

The motors extend symmetrically on one side and the other of the axis of rotation of the rotatable structure, which cooperates with drive means which position the said structure and make it rotate.

According to the invention, the rotors are supported by bearings which are housed in seatings made in the two body sides of the rotary structure; the body sides are positioned in front and behind the rotor, and in contact therewith.

In this way it is possible to have a rigid, stable structure.

The stator is torsionally connected to one body side, for example the front body side, or to a bar element which connects the two body sides.

The seating for the bearings is made so as to cooperate with a cap-type element which is stably connected with attachment means to the underlying base; the cap-type element and the underlying base together form one body side.

This solution maintains a high structural rigidity of the system and at the same time it makes it possible to dismantle both the mandrel and the rotor plus the stator together.

According to a variant, the stator is divided lengthwise into two parts, so that by opening the stator, that is, by dismantling one of its parts, it is possible to remove the rotor without dismantling the whole stator.

The axial position of the motors connected to the respective shafts of the mandrel, and also the proximity to the position of maximum load, minimises the forces and mechanical stresses for the transmission of motion, even when there are extremely steep slopes of acceleration/deceleration.

In fact, the connection of the motor and mandrel is extremely compact and torsionally rigid.

This solution simplifies and lightens the structure, and makes it extremely easy and quick to maintain or replace any components or even the mandrel itself.

According to one embodiment of the invention, the means to circumferentially position the rotatable structure consist of motor means arranged on the axis of the axis of rotation of the structure.

According to a variant, the circumferential positioning means consist of motor means with an axis orthogonal to the axis of rotation and connected to the rotatable structure by a kinematic chain with bevel gears. or with a worm screw.

According to a further variant, the circumferential positioning means consist of motor means with an axis lying on a plane parallel to but misaligned from the axis of rotation of the structure, and cooperating with intermediate means to transmit motion.

BRIEF DESCRIPTION OF THE DRAWINGS

The attached Figures are given as a non-restrictive example and show two preferential embodiments of the invention as follows.

DETAILED DESCRIPTION OF THE PREFERRED EMBODIMENT

Figure 1:
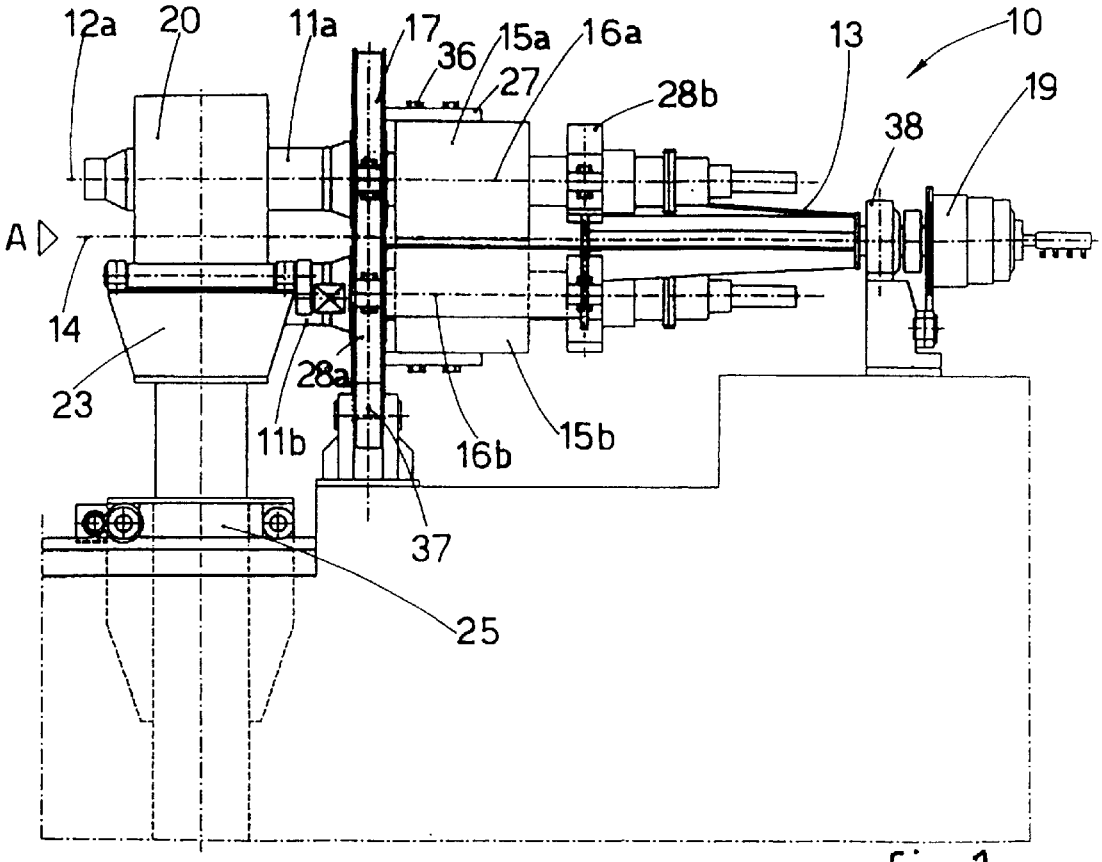
FIG. 1 shows a side view of a first embodiment of the carousel winding reel according to the invention.
Figure 2:
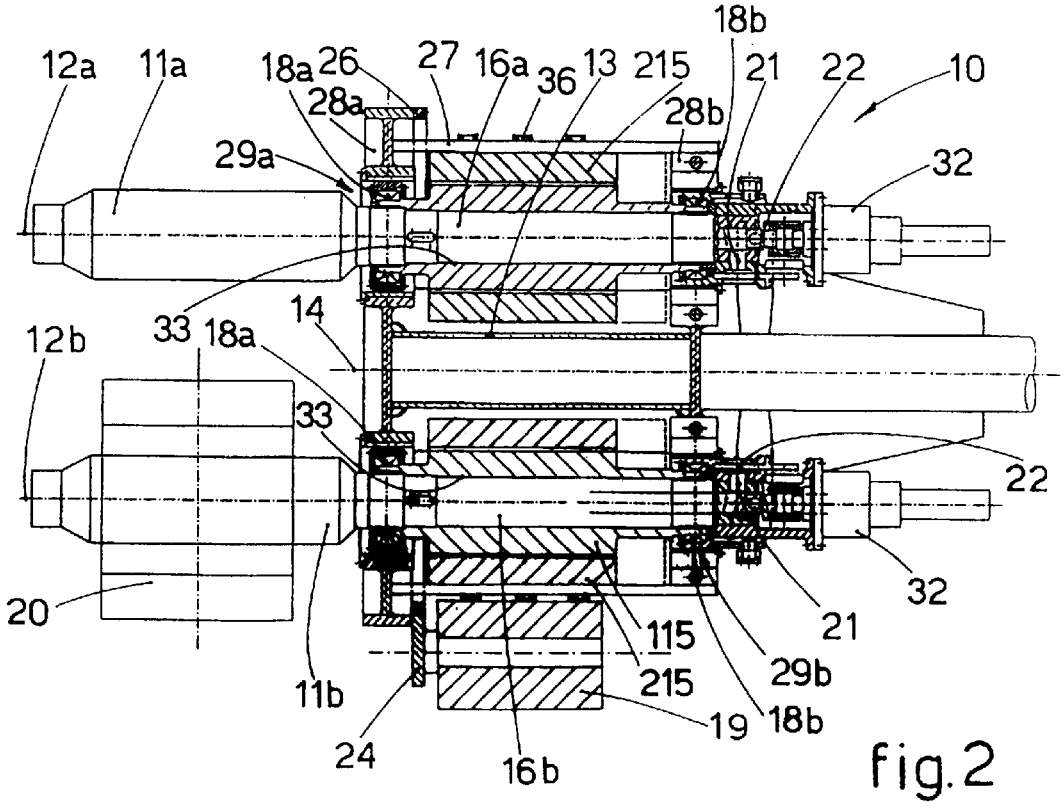
FIG. 2 shows in part cross section a variant of FIG. 1.

The carousel winding reel 10 for hot winding according to the invention is shown in two possible variants in FIGS. 1 and 2.

The reel 10 has an axis of rotation and positioning 14 and two rotating mandrels, 11*a* and 11*b*, including respective longitudinal axes 12*a* and 12*b* and mounted cantilevered with respect to a rotatable structure 13.

The axis of rotation and positioning 14 is between the two axes 12*a* and 12b.

According to the invention, each mandrel 11*a*, 11*b* is axially associated with a respective drive motor, respectively 15*a* and 15b.

Each drive motor 15*a*, 15*b* consists of a rotor 115 and a stator 215.

The stator 215 is made torsionally attached to the rotatable structure 13 by anti-torsion means 27 which are connected to the stator 215 by attachment means 36.

The anti-torsion means 27 may be of the bridge type, connecting the body sides 28*a* and 28*b* of the rotatable structure 13, or they may be associated with one body side 28 or the other.

The seatings 29*a* and 29*b* for the main bearings 18*a*, 18*b* are on the body sides 28*a* and 28*b*.

The seatings 29 are obtained substantially orthogonally to the plane of conjunction 34 between the cap-type element 30 and the base 31, the cap-type element 30 being made temporarily solid with the base 31 by attachment means so as to form one body side 28 or the other.

The bearings 18*a* and 18*b* cooperate directly with the rotor 115, they position it and support it.

In order to remove the motor 15, first the stator 215 must be disconnected from the anti-torsion means 27 and then the cap-type elements 30 corresponding to the bearings of a rotor 115 must be dismantled.

The rotor 115 has an axial seating 33 suitable to receive the shaft 16 of the mandrel 11, clamping it torsionally but leaving it free to slide axially.

Rear hydraulic means 32 axially clamp the shaft 16 and give it the hydraulic and command functions it needs; the rear hydraulic means 32 include conventional means to axially clamp-unclamp the shaft 16 and to provide the necessary services and commands.

Figure 3:
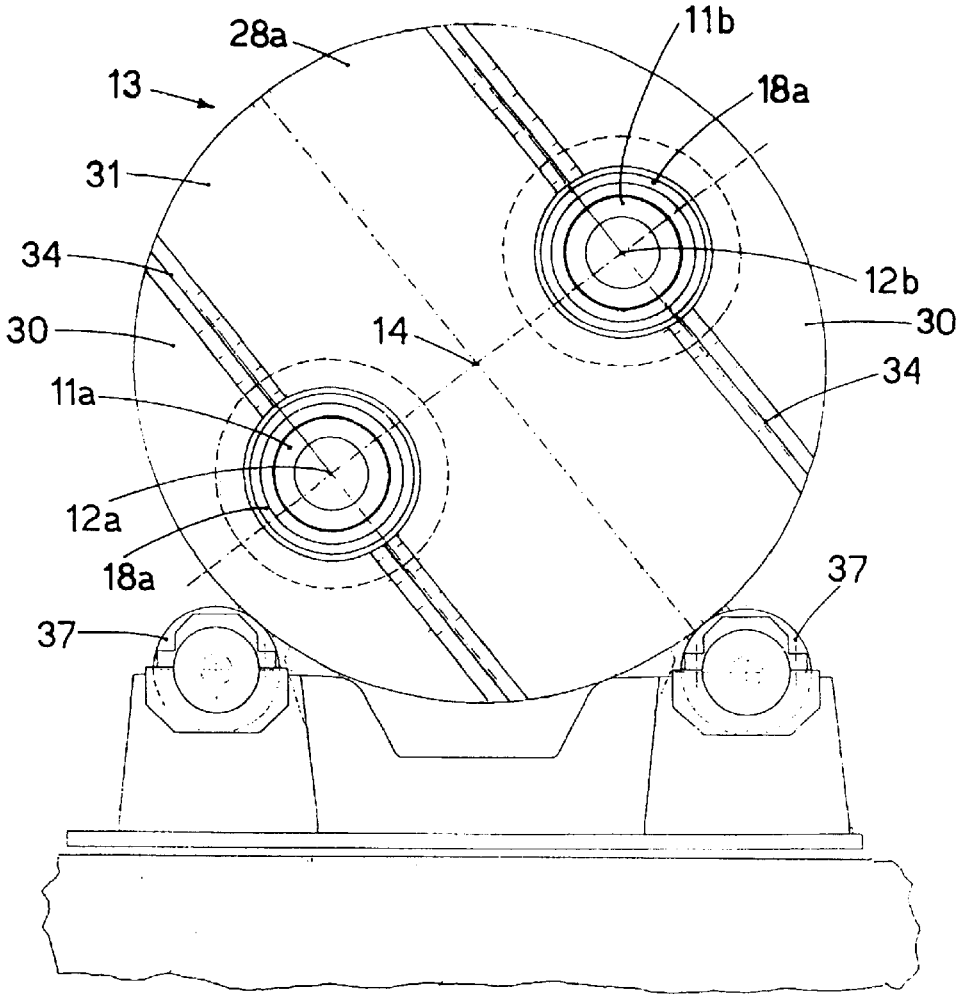
FIG. 3 is a front view from "A" of the variant shown in FIG. 1.

In the case shown in FIGS. 1 and 3, the front body side 28*a* is located on rollers 37 and the rotatable structure 13 is supported at the rear by a support 38 which supports the shaft connected to the motor 19 which serves to circumferentially position the rotatable structure 13 and therefore the mandrels 11.

The position of the motors 15*a*, 15*b* on an axis with the respective mandrels 11*a*, 11*b* and directly gripping the mandrel shafts 16*a*, 16*b* in a position of close proximity ensures an extremely efficient transmission of motion, resistant to mechanical, heat and electric stresses, even violent ones, in a structure which is easy to maintain and to disassemble.

The motor 19 allows the rotatable structure 13 to rotate so as to take the mandrels 11*a*, 11*b*, according to the step of the winding cycle, from the winding position to the stand-by position and vice versa.

The inclusion of the motor 19 coaxial with the axis of rotation of the rotatable structure 13 and directly gripping the rotation shaft without intermediate elements to transmit the motion, such as gears, joints, etc. ensures a high resistance to mechanical stresses and an efficient transmission of motion.

FIG. 2 shows an example of the rapid attachment/detachment elements 21 and the assembly bushings 22 for the rapid replacement of the mandrels 11*a*, 11*b*.

FIG. 1 shows the vertical supporting element 23 which supports the coil 20 once winding is completed and the relative trolley 25 to extract the coil 20 from the reel.

There may also be included a further supporting element cooperating with the outer end of the mandrel shaft and not shown here; it is used to support the weight of the coil 20 as it is being wound in the final position.

In the variant shown in FIG. 2, the motor 19 which makes the rotatable structure 13 rotate is placed on an axis parallel to but not coincident with the longitudinal axis of rotation 14 of the structure itself and transmits the motion thereto by means of a transmission gear 24 and a toothed wheel 26.

According to a further variant, the motor 19 has an axis orthogonal to the longitudinal axis 14 of the rotatable structure 13.

Figure 4:
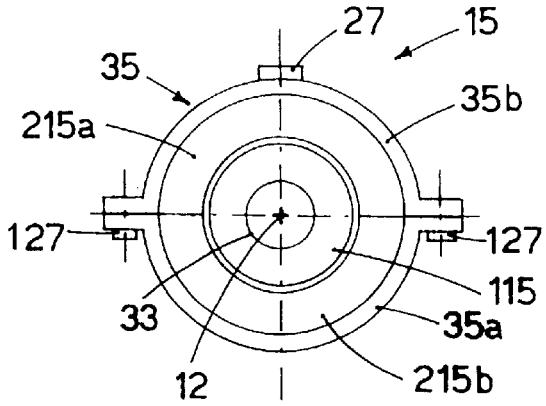
FIG. 4 shows a variant of the axial motor shown in FIG. 1.

FIG. 4 shows a variant of the motor 15 in which the stator 215 is in two halves (215*a* and 215*b*); the two halves are reciprocally attached and positioned by a connecting case 35 also of two halves 35*a* and 35*b*.

In this case the anti-torsion means 27 may be positioned in any position whatsoever, for example 127, also in relation to the half-body of the connecting case 35.

What is claimed is:

1. Carousel winding reel for thin or very thin strip/sheet, up to 0.5 mm, hot rolled and leaving as a continuous strip from a rolling train at speeds of 20 metres per second and more, the reel (11) comprising a pair of mandrels (11*a*, 11*b*), arranged with their respective axes parallel to each other (12*a*, 12*b*) and associated with a structure (13) able to rotate around a longitudinal axis (14) substantially between the axes (12*a*, 12*b*) of said mandrels (11*a*, 11*b*), the rotatable structure (13) including a front body side (28*a*) and a rear body side (28*b*), the mandrels (11*a*, 11*b*) including alternately a position of winding and a position of stand-by, the mandrels (11*a*, 11*b*) and the rotatable structure (13) cooperating with respective drive means and with a beam structure (17) attached to the floor, wherein the drive means of the mandrels (11*a*, 11*b*) consisting of respective motors (15*a*, 15*b*) each of which is arranged coaxially with the respective mandrel (11*a*, 11*b*) and is positioned between the said body sides (28), the motors (15) including a stator (215) and a rotor (115), the stator (215) of each motor (15*a*, 15*b*) being connected with at least one of said body sides (28) by anti-torsion means (27), the winding reel being characterised in that each of said body sides (28) comprises a central base element (31) and two removable cap elements (30) associated thereto and in that the seatings (29) for the main bearings (18) of the rotor (115) of each motor (15*a*, 15*b*) are realised partly in said central base element (31) and partly in said two removable cap elements (30).

2. Winding reel as in claim 1, characterised in that the rotors (115) include an axial cavity associated with the respective shaft (16) of the mandrel (11), the association being torsionally stable and axially movable.

3. Winding reel as in claim 1, characterised in that the planes of conjunction (34) of said cap elements (30) with said central base element (31) are substantially parallel therebetween and to said longitudinal axis (14).

4. Winding reel as in claim 3, characterised in that the plane of conjunction (34) divides the seatings (29) of the main bearings (18) into two substantially coinciding halves.

5. Winding reel as in claim 1, characterised in that the drive means of the rotatable structure (13) consist of motor means (19) coaxial with the longitudinal axis of rotation (14) of the rotatable structure (13).

6. Winding reel as in claim 1, characterised in that the drive means of the rotatable structure (13) consist of motor means (19) arranged with their axis parallel to and misaligned from the longitudinal axis of rotation (14) of the rotatable structure (13).

7. Winding reel as in claim 1, characterised in that the drive means of the rotatable structure (13) consist of motor means (19) arranged with their axis orthogonal to the longitudinal axis of rotation (14) of the rotatable structure (13).

8. Carousel winding reel for thin or very thin strip/sheet, up to 0.5 mm, hot rolled and leaving as a continuous strip from a rolling train at speeds of 20 metres per second and more, the reel (11) comprising a pair of mandrels (11*a*, 11*b*) arranged with their respective axes parallel to each other (12*a*, 12*b*) and associated with a structure (13) able to rotate around a longitudinal axis (14) substantially between the axes (12*a*, 12*b*) of said mandrels (11*a*, 11*b*), the rotatable structure (13) including a front body side (28*a*) and a rear body side (28*b*), the mandrels (11*a*, 11*b*) including alternately a position of winding and a position of stand-by, the mandrels (11*a*, 11*b*) and the rotatable structure (13) cooperating with respective drive means and with a beam structure (17) attached to the floor, wherein the drive means of the mandrels (11*a*, 11*b*) consist of respective motors (15*a*, 15*b*) each of which is arranged coaxially with the respective mandrel (11*a*, 11*b*) and is positioned between the said body sides (28), the motors (15) including a stator (215) and a rotor (115), the stator (215) being connected with at least one body side (28) by anti-torsion means (27), the winding reel being characterised in that the body sides (28) include the seatings (29) for the main bearings (18) of the rotor (115), and the rotors (115) include an axial cavity associated with the respective shaft (16) of the mandrel (11), which association being torsionally stable and axially movable.

9. Winding reel as in claim 8, characterised in that in correspondence with a seating (29) of the main bearings (18) there is the plane of conjunction (34) of a cap element (30) with the base (31), the combination of at least one cap element (30) and the base (31) constituting a body side (28).

10. Winding reel as in claim 9, characterised in that the plane of conjunction (34) divides the seatings (29) of the main bearings (18) into two substantially coinciding halves.

11. Winding reel as in claim 8, characterised in that the drive means of the rotatable structure (13) consist of motor means (19) coaxial with the longitudinal axis of rotation (14) of the rotatable structure (13).

12. Winding reel as in claim 8, characterised in that the drive means of the rotatable structure (13) consist of motor means (19) arranged with their axis parallel to and misaligned from the longitudinal axis of rotation (14) of the rotatable structure (13).

13. Winding reel as in claim 8, characterised in that the drive means of the rotatable structure (13) consist of motor means (19) arranged with their axis orthogonal to the longitudinal axis of rotation (14) of the rotatable structure (13).

* * * * *